US005532659A

United States Patent [19]

Dodart

[11] Patent Number: 5,532,659

[45] Date of Patent: Jul. 2, 1996

[54] CONNECTION DEVICE TO PROVIDE A CONNECTION, BY COAXIAL CABLE, TO A PRINTED CIRCUIT

[75] Inventor: André Dodart, Eragny S/oise, France

[73] Assignee: Thomson-CSF, Paris, France

[21] Appl. No.: 441,408

[22] Filed: May 15, 1995

[30] Foreign Application Priority Data

May 19, 1994 [FR] France ..... 94 06123

[51] Int. Cl.[6] ..... H01P 5/08; H01R 9/09

[52] U.S. Cl. ..... 333/260; 439/63

[58] Field of Search ..... 333/33, 260; 439/59, 439/63, 581

[56] References Cited

U.S. PATENT DOCUMENTS

| | | | |
|---|---|---|---|
| 3,201,721 | 8/1965 | Voelcker | 333/33 |
| 3,539,966 | 11/1970 | Logan | 333/260 X |
| 3,662,318 | 5/1972 | Decuyper | 333/260 X |
| 4,995,815 | 2/1991 | Buchanan et al. | 439/63 |
| 4,996,478 | 2/1991 | Pope | 333/260 X |
| 5,404,117 | 4/1995 | Walz | 333/260 X |

FOREIGN PATENT DOCUMENTS

| | | |
|---|---|---|
| 0341535 | 11/1989 | European Pat. Off. . |
| 2748818 | 3/1979 | Germany . |

*Primary Examiner*—Paul Gensler

*Attorney, Agent, or Firm*—Oblon, Spivak, McClelland, Maier & Neustadt

[57] ABSTRACT

The disclosure relates to the connection of a coaxial cable to a printed circuit. There is proposed a device having a U-shaped metal part that fits into the edge of the printed circuit; a hole drilled into the bottom of the part enables the introduction of the bared end of a coaxial cable, wherein a contact is provided between the external conductor of the cable and the part; the internal conductor of the cable extending within the U and, by use of an aperture in the U, it can be soldered to a conductor of the printed circuit. In addition, a lid is placed on the aperture to prevent parasitic radiation.

8 Claims, 2 Drawing Sheets

CONNECTION DEVICE TO PROVIDE A CONNECTION, BY COAXIAL CABLE, TO A PRINTED CIRCUIT

BACKGROUND OF THE INVENTION

1. Field of the Invention

The present invention relates to the connection of a coaxial cable to a printed circuit.

2. Discussion of the Background

There are known ways of directly connecting the end of a coaxial cable to a printed circuit by soldering, the internal and external conductors of the end of the cable to positions used for this purpose in the printed circuit. Such a connection is generally flimsy. It stands up poorly to the conditions of a harsh mechanical environment and does not easily lend itself to industrial-scale mass production methods because it does not ensure the constancy of transition impedance from one connection to another. There is also a known way of using a connection strip or connection box between the cable and the printed circuit. Such connections have at least one of the following defects: costly, are bulky and they cannot be implemented on an industrial scale.

SUMMARY OF THE INVENTION

The aim of the present invention is to circumvent or at least to reduce these defects.

This is obtained by means of an assembly specially designed to resolve the problem raised.

According to the present invention, there is provided a connection device to provide a connection by coaxial cable to a printed circuit, comprising:

- a coaxial cable with an internal conductor, an external conductor and an end bared to reveal its internal and external conductors,
- a U-shaped fixed metal part comprising a bottom and a first plate and second plate positioned on either side of the bottom so as to constitute the vertical arms of the U, this part being designed to fit into the printed circuit with the two plates on either side of the printed circuit, the bottom being pierced through with a hole, referred to as a connection hole, having a wall, this hole being designed to receive the bared end of the cable with the internal conductor that emerges from the interior of the U and the external conductor in contact with the wall of the hole, an aperture being cut out in the first plate in the vicinity of the place reached by the internal conductor, P1 means to fix the U-shaped part to the printed circuit; P1 and a metal cap to cover the aperture.

BRIEF DESCRIPTION OF THE DRAWINGS

The present invention shall be understood more clearly and other characteristics shall appear from the following description and from the figures pertaining thereto, of which.

In the different figures, the corresponding elements are designated by the same references.

DESCRIPTION OF THE PREFERRED EMBODIMENT

Figure 1:
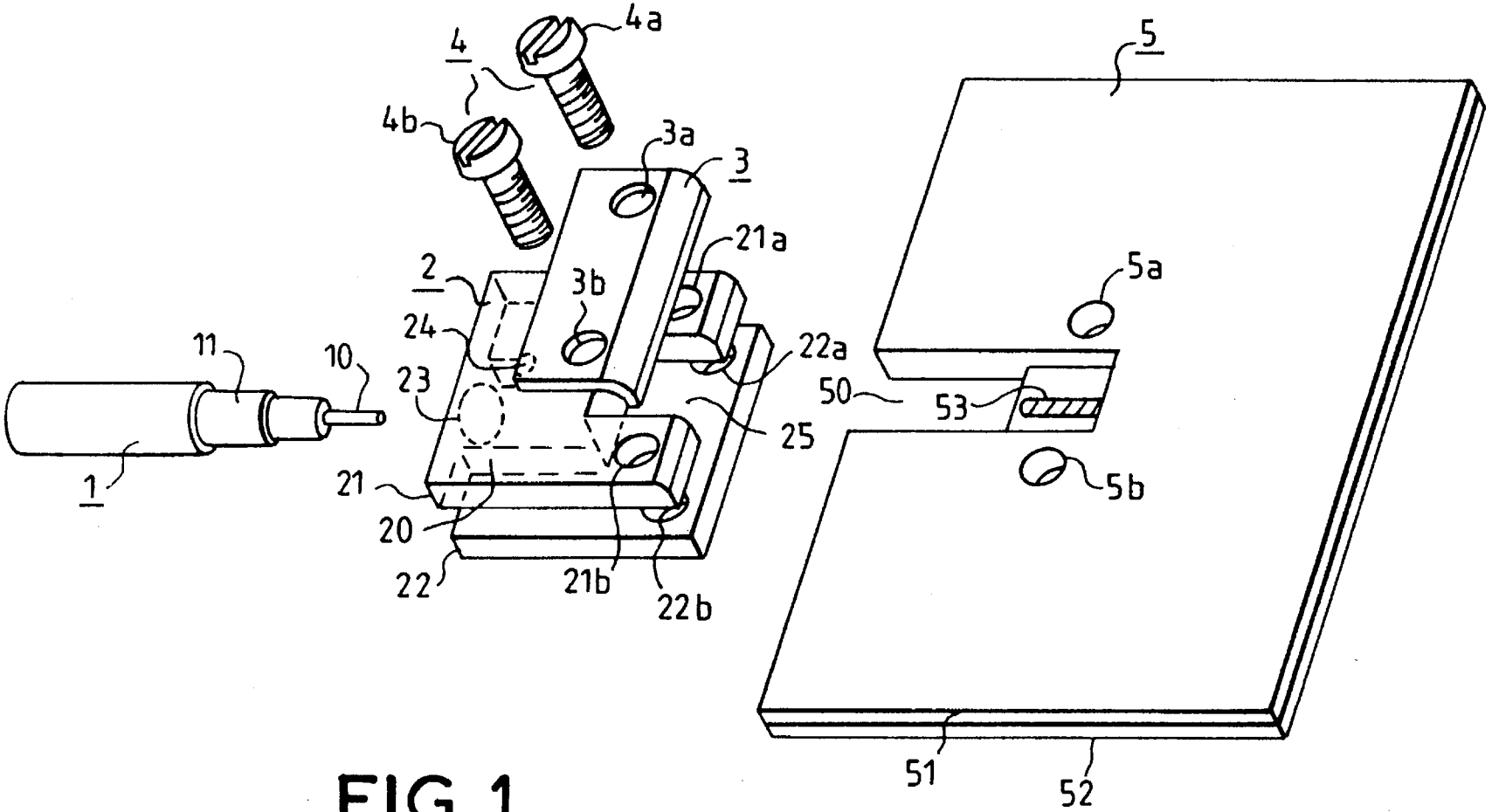
FIGS. 1 and 3 show views in perspective of a connection device according to the invention with a printed circuit for which it is designed.

FIG. 1 shows the following in an exploded view: a cable 1, a printed circuit 5 and a connection device 2, 3, 4 to connect an end of the cable 1 to the circuit 5.

The end of the cable 1 which must be connected to the circuit 5 is bared in order to reveal the internal conductor 10 and the external conductor 11.

In the example described, the circuit 5 is a stripline circuit whose external faces 51, 52 bear the ground planes and whose internal face has conductors such as the conductor 53 that is revealed by a notch 50. This notch is specially made in order to set up the connection between the cable 1 and the printed circuit 5; it clears the insulating upper substrate on a width of 4 mm and a length of 9.5 mm and clears the lower insulating substrate on the same width but on a length of 6 mm.

On either side of the notch 50, the printed circuit is drilled with circular holes *5a*, *5b*.

The connection device has a fixed metal jaw 2, a metal cap 3 and fastening means 4 to fasten the jaw and the cap to the circuit 5.

The jaw 2 is an integral or single-piece unit made by machining. It may be described as being formed by the superimposition of three attached plates, a first plate and second plate 21, 22, located on either side of a third plate 20, and forming a U. The third plate 20 constitutes the bottom of this U and shall hereinafter be called the bottom plate. The distance between the first plate and the second plate is slightly greater than the thickness of the printed circuit 5.

The bottom plate 20 has a width of 3.8 mm and a length of 6 mm. By contrast, the plates 21, 22 have a width of 10 mm and an overall length of 9.5 mm so much so that their dimensions are greater than those of the notch 50. In the upper part of the U, where it is not superimposed on the bottom plate 20, the plate 21 has a rectangular notch 25 cut out of it. This notch 25 is positioned in the extension of the part of the plate 21 that covers the bottom plate 20. The plate 21 thus has two strips, one on each side of the notch 25. These two tongues are respectively pierced with two smooth holes *21a*, *21b* perpendicular to the plane of the plate 21. Facing these two smooth holes, the plate 22 is drilled with two threaded holes *22a*, *22b*.

The jaw 2 is drilled with two other smooth holes 23 and 24. The hole 23 goes right through the bottom plate 20 while the hole 24 goes through the bottom plate 20 and opens into the hole 23.

The jaw 2 that has just been described has been designed to fit into the part of the circuit 5 in which the notch 50 is cut out. When the fitting in is done, the bottom plate 20 is entirely within the notch 50 of the circuit 5, while the notch 25 of the plate 21 of the jaw constitutes an aperture that reveals the part of the internal face of the circuit 5 that is visible through the notch 50 and comprises the conductor 53.

Figure 2:
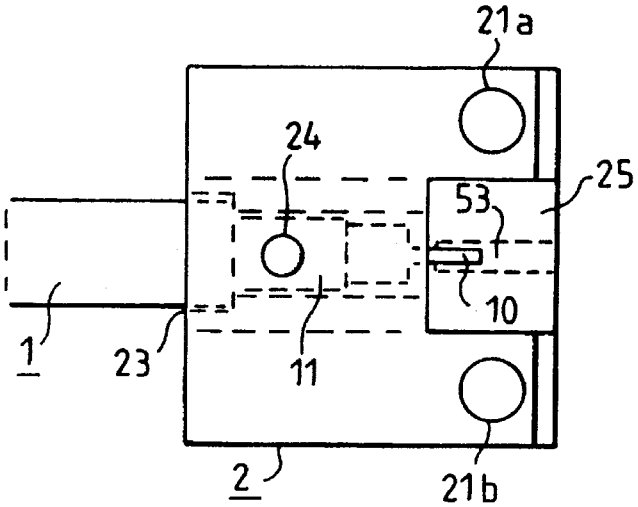
FIG. 2 shows a top view of the connection device of figures 1 and 3.

In FIG. 2, which shows a top view of the jaw 2, the conductor 53 of the printed circuit 5 has been shown in dashes in the position that it occupies with respect to the jaw 2 when the jaw is fitted in. This figure also shows the cable 1 which has already been described by means of FIG. 1 but which, in this case, has been pushed into the hole 23. It must be noted that the cable 1, as bared at its end, has its external conductor 11 below the hole 24 and its internal conductor 10 above the conductor 53. This makes it possible to make two electrical links, one link between the jaw and the external conductor 11 by means of solder introduced through the hole 24 and one link, also by soldering, between the internal conductor 10 and the conductor 53. The latter link is made possible by the aperture formed through the notch 25. However, this aperture raises a problem since it lets through the radio-electric radiation produced at the conductor 53. This is why there is provision for a metal cap 3 to close the aperture 25.

Figure 3:
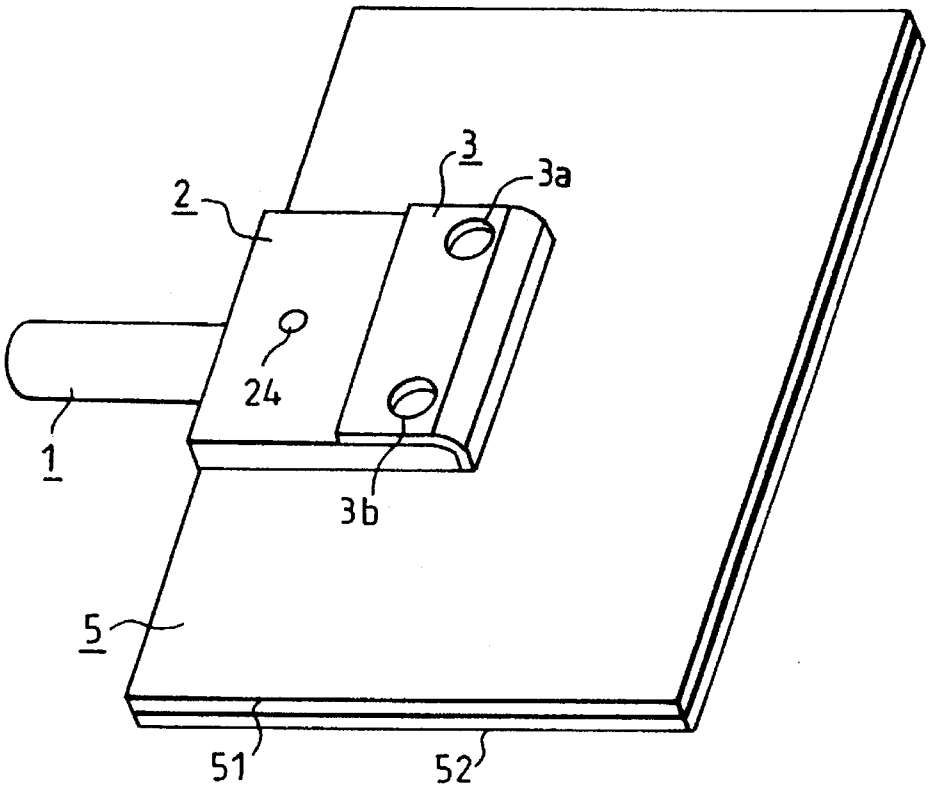

The cap 3 is constituted by a metal plate having the same width as the plates 21 and 22 but a smaller length. This cap is bent so as to get placed flat against not only the face of the plate 21 opposite the plate 22 but also at the end of the plate 21 located at the top of the U. FIG. 3 shows the respective positions of the printed circuit 5, the coaxial cable 1 of the jaw 2 and of the cap 3 after they have been joined. In this figure, it can be seen that the cap then comes into contact not only with the jaw 2 but also with the ground plane of the external face 51 of the printed circuit 5, thus setting up an effective barrier against the radiation produced at the conductor 53.

The mechanical assembly, as shown in FIG. 3, cannot hold since, in particular, the cap 3 is simply laid on the jaw 2. To provide for the fastening of the assembly according to FIG. 3, there is provision, as can be seen in FIG. 1, for fastening means 4 formed by two screws 4*a*, 4*b* designed to cross two smooth holes 3*a*, 3*b* of the cap 3 and the pairs of corresponding holes 21*a*-21*b*, 22*a*-22*b*, 5*a*- 5*b* described by means of FIG. 1. All these pairs of holes have the same distance between the axes of their two holes and are superimposed with precision in the assembly according to FIG. 3, so much so that the screws 4*a*, 4*b* can easily be introduced into these superimposed holes to get screwed into the threaded holes 22*a*, 22*b* of the plate 22 of the jaw, thus fixedly joining together the elements 2, 3, 5 of the assembly according to FIG. 3.

The present invention is not limited to the example described. It is thus, in particular, that the aperture 25, instead of being a notch, may be a hole having dimensions sufficient to enable the soldering of the internal conductor 10 to the conductor 53 of the printed circuit. In this case, the cap does not need to be bent since the aperture does not open into the top of the U and a flat plate therefore suffices to close such an aperture.

Similarly, other fastening means could be envisaged. These are, for example, the fitting, by hard friction, of the jaw 2 to the circuit 5 and of the cap 3 to the jaw 2, the cap sliding for example between two parallel rails, fixedly joined to the jaw 2.

What is claimed is:

1. A connection device providing a coaxial cable connection to a printed circuit, comprising:

coaxial cable with an internal conductor, an external conductor and an end bared to reveal the internal and external conductors, a U-shaped fixed metal part which includes a bottom plate and a first and second plate respectively positioned on either side of the bottom plate so as to form vertical arms of the U-shaped metal part, said U-shaped metal part fitting into the printed circuit with the first and second plates being respectively positioned on either side of the printed circuit, the bottom plate including a hole formed therein which has a wall, the hole receiving the bared end of the cable with the internal conductor wherein the internal conductor is located within the U-shaped metal part and the external conductor is in contact with the wall of the hole, and wherein the first plate has an aperture located therein which is located in proximity with a location where the internal conductor emerges within the U-shaped metal part, at least one fastening member fixing the U-shaped metal part to the printed circuit; and a substantially flat metal cap covering the aperture and overlapping at least one of the vertical arms of the U-shaped metal part.

2. A device according to claim 1, wherein said flat metal cap overlaps each of the vertical arms of the U-shaped metal part.

3. A connection device providing a coaxial cable connection to a printed circuit, comprising:

a coaxial cable with an internal conductor, an external conductor and an end bared to reveal the internal and external conductors, a U-shaped fixed metal part which includes a bottom plate and a first and second plate respectively positioned on either side of the bottom plate so as to form vertical arms of the U-shaped metal part, said U-shaped metal part fitting into the printed circuit with the two plates being respectively positioned on either side of the printed circuit, the bottom plate including a hole formed therein which has a wall, the hole receiving the bared end of the cable with the internal conductor wherein the internal conductor is located within the U-shaped metal part and the external conductor is in contact with the wall of the hole, and wherein the first plate has an aperture located therein which is located in proximity with a location where the internal conductor emerges within the U-shaped metal part, at least one fastening member fixing the U-shaped metal part to the printed circuit; and a substantially flat metal cap covering the aperture, wherein the bottom plate has a soldering hole formed therein, said soldering having two ends which open, respectively, into an exterior portion of the U-shaped metal portion and an interior portion of the connection hole, and wherein solder is introduced into the soldering hole during assembly of the device and provides a contact between the wall of the connection hole and the external conductor.

4. A connection device providing a coaxial cable connection to a printed circuit, comprising:

a coaxial cable with an internal conductor, an external conductor and an end bared to reveal the internal and external conductors, a U-shaped fixed metal part which includes a bottom plate and a first and second plate respectively positioned on either side of the bottom plate so as to form vertical arms of the U-shaped metal part, said U-shaped metal part, fitting into the printed circuit with the two plates being respectively positioned on either side of the printed circuit, the bottom plate including a hole formed therein which has a wall, the hole receiving the bared end of the cable with the internal conductor wherein the internal conductor is located within the U-shaped metal part and the external conductor is in contact with the wall of the hole, and wherein the first plate has an aperture located therein which is located in proximity with a location where the internal conductor emerges within the U-shaped metal part, at least one fastening member fixing the U-shaped metal part to the printed circuit; and a substantially flat metal cap covering the aperture, wherein the bottom plate has a width which is less than the first and second plates, said first and second plates extending beyond the bottom plate on each side of the bottom palate.

5. A connection device providing a coaxial cable connection to a printed circuit, comprising:

a coaxial cable with an internal conductor, an external conductor and an end bared to reveal the internal and external conductors, a U-shaped fixed metal part which includes a bottom plate and a first and second plate respectively positioned on either side of the bottom plate so as to form vertical arms of the U-shaped metal part, said U-shaped metal part, fitting into the printed circuit with the two plates being respectively positioned on either side of the printed circuit, the bottom plate including a hole formed therein which has a wall, the hole receiving the bared end of the cable with the internal conductor wherein the internal conductor is located within the U-shaped metal part and the external conductor is in contact with the wall of the hole, and wherein the first plate an aperture located therein which is in proximity with a location where the internal conductor emerges within the U-shaped metal part, at least one fastening member fixing the U-shaped metal part to the printed circuit; and a substantially flat metal cap covering the aperture, wherein the aperture of the first plate comprises a notch formed in the first plate from a top portion of the arm of the U-shaped metal plate and wherein the cap comprises a third plate that is screwed to the U-shaped metal part and is bent to form a wall that covers the notch opposite the second plate and opposite the bottom of the U-shaped metal plate.

6. A device according to claim 5, wherein the fastening member comprise screws that extend through at least one of the first and second plates and extend through the third plate to fasten the third plate to the U-shaped metal part.

7. A connection device providing a coaxial cable connection to a printed circuit, comprising:

a coaxial cable with an internal conductor, an external conductor and an end bared to reveal the internal and external conductors, a U-shaped fixed metal part which includes a bottom plate and a first and second plate respectively positioned on either side of the bottom plate so as to form vertical arms of the U-shaped metal part, said U-shaped metal part fitting into the printed circuit with the two plates being respectively positioned on either side of the printed circuit, the bottom plate including a hole formed therein which has a wall, the hole receiving the bared end of the cable with the internal conductor wherein the internal conductor is located within the U-shaped metal part and the external conductor is in contact with the wall of the hole, and wherein the first plate has an aperture located therein which is located in proximity with a location where the internal conductor emerges within the U-shaped metal part, at least one fastening member fixing the U-shaped metal part to the printed circuit; and a substantially flat metal cap covering the aperture, wherein the at least one fastening member further comprises screws that extend through at least one of the first and second plates.

8. A device according to claim 7, wherein the fastening member comprise screws that extend through at least one of the first and second plates and extend through the third plate to fasten the third plate to the U-shaped metal part.

* * * * *